US005287479A

United States Patent [19]

Masaru et al.

[11] Patent Number: 5,287,479

[45] Date of Patent: Feb. 15, 1994

[54] FLYBACK TRANSFORMER

[75] Inventors: Omura Masaru; Nagai Tadao; Naitou Kenji, all of Kyoto, Japan

[73] Assignee: Murata Mfg. Co. Ltd., Kyoto, Japan

[21] Appl. No.: 868,764

[22] Filed: Apr. 14, 1992

[30] Foreign Application Priority Data

Apr. 15, 1991 [JP] Japan ..... 3-33957[U]

[51] Int. Cl.[5] ..... H01J 29/70; G09G 1/04

[52] U.S. Cl. ..... 323/359; 323/358; 363/21; 361/836; 29/602.1; 315/411

[58] Field of Search ..... 174/52.1, 52.2; 29/602.1; 363/21; 323/355, 358, 359, 362; 315/411; 361/331, 380, 394, 395, 399

[56] References Cited

U.S. PATENT DOCUMENTS 4,403,403 9/1983 Hosoya et al. ..... 29/602.1
4,527,229 7/1985 Imamura et al. ..... 315/411 X
5,160,872 11/1992 Kenji et al. ..... 315/411

*Primary Examiner*—Emanuel T. Voeltz
*Attorney, Agent, or Firm*—Townsend and Townsend Khourie and Crew

[57] ABSTRACT

In a flyback transformer having a focus pack, in order to facilitate the manufacture and assembly of the focus pack, the focus pack mounted on the flyback transformer is constituted by an outer case portion and an inner case portion, and the outer and inner case portions are coupled to each other by a coupling portion and integrally formed. The inner case portion contains a circuit board having a resistor circuit for setting a focus adjusting voltage and a screen adjusting voltage. A focus insertion hole and a screen insertion hole are formed in the coupling portion. A focus shaft for variably setting a focus adjusting voltage is rotatably fitted in the focus insertion hole. A screen shaft for variably setting a screen adjusting voltage is rotatably fitted in the screen insertion hole. An insulating casting resin is injected between the gaps between the outer and inner case portions.

6 Claims, 3 Drawing Sheets

PRIOR ART

FLYBACK TRANSFORMER

BACKGROUND OF THE INVENTION

1. Field of the Invention

The present invention relates to a flyback transformer having a focus pack.

2. Description of the Prior Art

A television receiver requires various voltages ranging from a low voltage to a high voltage. In order to obtain such voltages, the receiver uses a flyback transformer which is designed such that a DC voltage of 100 V produced by a power supply circuit is received at the primary winding, and a high voltage of 30 kV and a low voltage of 10 to 200 V are respectively obtained from the secondary and tertiary windings.

A high voltage (e.g., 25 kV) generated by the flyback transformer is applied to the anode of a cathode-ray tube. At the same time, this high voltage is appropriately decreased across a resistor to obtain a focus voltage (e.g., 10 kV) to be applied to an electron beam focusing electrode arranged in an electron gun, and a screen voltage (e.g., 1 kV) to be applied to a screen electrode for color adjustment.

FIG. 1 shows a typical flyback transformer. In order to obtain a focus voltage and a screen voltage from a high voltage generated by the flyback transformer, a unit called a focus pack, denoted by reference numeral 2, is used.

FIG. 1 shows a flyback transformer 1 and the focus pack 2. The flyback transformer is designed such that a core 1*a* is inserted in the center of a bobbin having windings wound therearound, and the bobbin is entirely housed in a transformer case 1*b*. The focus pack 2 is mounted on an outer surface of the flyback transformer 1. A high voltage generated by the flyback transformer 1 is applied to an anode cap (not shown) through a lead 1*c* and to a high-voltage application point (to be described later) in the focus pack 2.

The focus pack 2 has outer and inner cases 21 and 22, each consisting of a resin, as shown in FIG. 3. A ceramic board 20 on which a high-voltage resistor portion 20*a* and variable resistive elements 20*b* and 20*c* are printed as wiring patterns is arranged in the inner case 22, as shown in FIG. 2. A high voltage from the flyback transformer 1 is applied to a high-voltage application point A on the board 20, and a point B on the board 20 is grounded through a terminal 2*b*. As is apparent from FIG. 1, a focus shaft 3 and a screen shaft 4, both serving to perform voltage adjustment, are arranged on the front surface of the outer case 21, and sliders S1 and S2 (see FIG. 2) are respectively pivoted by the focus shaft 3 and the screen shaft 4 to slide on the variable resistive element 20*b* for focus voltage adjustment and on the variable resistive element 20*c* for screen voltage adjustment. One end of each of the sliders S1 and S2 is connected, through a corresponding one of printed wiring patterns 20*d* and 20*e* on the board 20, to a terminal (not shown) extending through the rear surface of the board 20.

As shown in FIGS. 3 and 4, the focus pack 2 of the flyback transformer 1 of this type has the outer and inner cases 21 and 22. A focus insertion hole 5 and a screen insertion hole 6 are formed in the outer case 21. A focus shaft retaining cylinder 7 and a screen shaft retaining cylinder 8 extend from the inner case 22. When the focus shaft retaining cylinder 7 and the screen shaft retaining cylinder 8 are respectively inserted in the focus insertion hole 5 and the screen insertion hole 6, the outer and inner cases 21 and 22 are fitted together.

The focus shaft 3 is inserted in the focus shaft retaining cylinder 7. The screen shaft 4 is inserted in the screen shaft retaining cylinder 8.

The outer case 21 is fitted in a transformer case 1*b*. In this state, an insulating casting resin 10 such as an epoxy resin is injected into the transformer case 1*b*, so that the interior of the transformer case 1*b* and the gap between the outer and inner cases 21 and 22 of the focus pack are filled with the insulating casting resin 10. As a result, the resistor circuit formed on the board 20 is insulated from the outside by the outer and inner cases 21 and 22 and the insulating casting resin 10.

According to the focus pack 21, however, since the outer and inner cases 21 and 22 are integrally assembled by fitting the retaining cylinders 7 and 8 for the focus and screen shafts 3 and 4 in the insertion holes 5 and 6, the outer and inner cases 21 and 22 must be independently manufactured. For this reason, the work efficiency in the manufacture/assembly of the apparatus is low. In addition, when the insulating casting resin 10 is injected between the outer and inner cases 21 and 22, the insulating casting resin 10 leaks from gaps 9 between the retaining cylinders 7 and 8 and the insertion holes 5 and 6.

SUMMARY OF THE INVENTION

The present invention has been made to solve the above-described conventional problems, and has as its object to provide a flyback transformer which can solve the problem of low work efficiency due to the manufacture and assembly of the separate outer and inner cases of a focus pack, and can prevent an insulating casting resin from leaking outside upon injection.

In order to achieve the above object, according to the present invention, there is provided a flyback transformer having a focus pack, wherein the focus pack includes an outer case portion and an inner case portion, the outer and inner case portions are integrally formed by coupling the top inner wall of the outer case portion to the top outer wall of the inner case portion by a coupling portion, an insulating casting resin is injected between the opposing surfaces of the outer and inner case portions except for the coupling portion, and a focus shaft insertion hole is formed in the coupling portion to extend through the inner case portion.

According to the present invention having the above-described arrangement, the outer and inner case portions constituting the focus pack mounted on a transformer case are coupled to each other by the coupling portion and integrally formed, and a focus shaft for variably adjusting a focus adjusting voltage is rotatably inserted in the focus shaft insertion hole formed in the coupling portion. For example, after the focus pack is mounted on the transformer case, the insulating casting resin is injected in the transformer case. The insulating casting resin flows into the gaps between the outer and inner case portions to increase the breakdown voltage of a circuit board housed in the inner case portion.

DETAILED DESCRIPTION OF THE PREFERRED EMBODIMENTS

An embodiment of the present invention will be described below with reference to the accompanying drawings.

Figure 1:
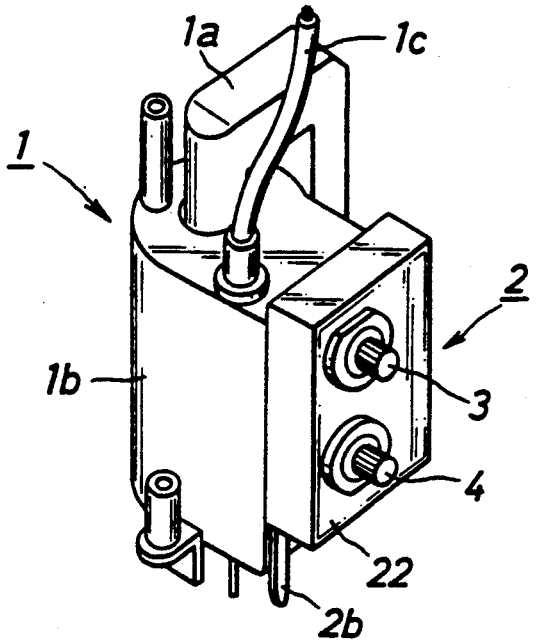
FIG. 1 is a perspective view showing a conventional flyback transformer.
Figure 2:
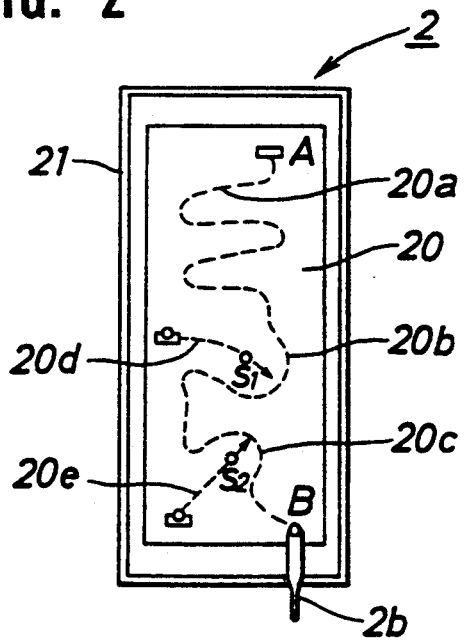
PRIOR ART FIG. 2
FIG. 2 is a view showing a resistive element pattern printed, as a wiring pattern, on a board incorporated in a focus pack of the flyback transformer shown in FIG. 1.
Figure 3:
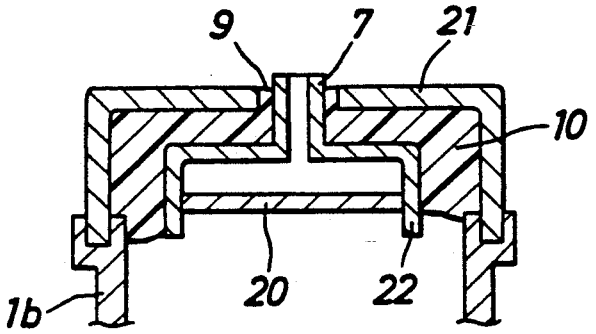
FIG. 3 is a sectional view showing a main part of a conventional focus pack mounted on the conventional flyback transformer.
Figure 4:
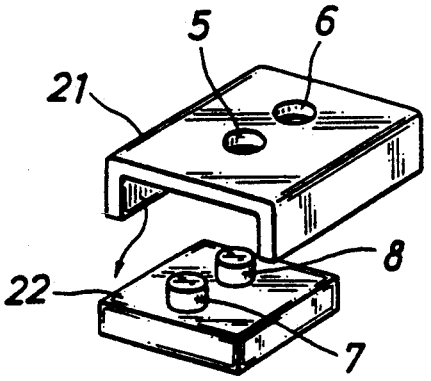
PRIOR ART FIG. 4
FIG. 4 is an exploded perspective view showing the conventional focus pack in FIG. 3.
Figure 5:
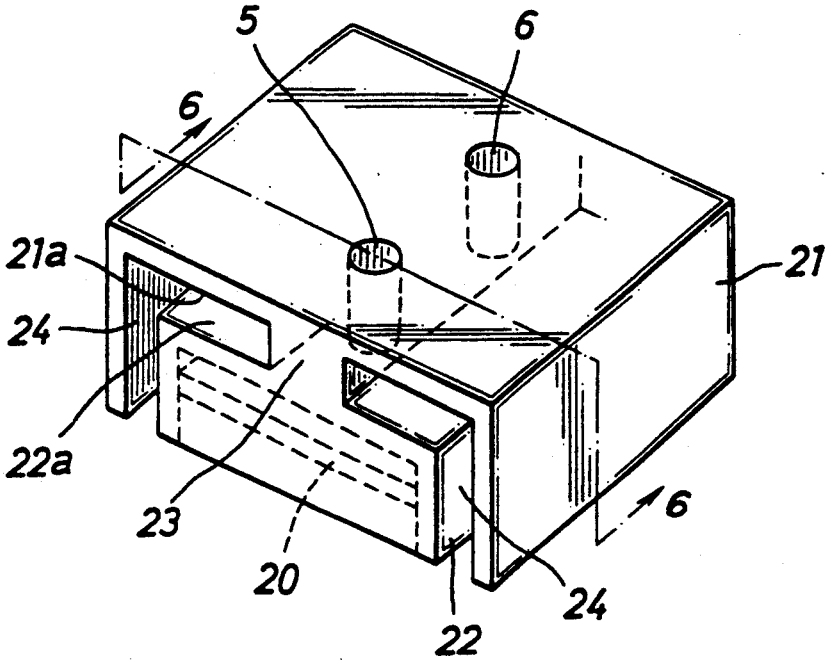
FIG. 5 is a perspective view showing a main part of an embodiment of a focus pack constituting a flyback transformer according to the present invention.
Figure 6:
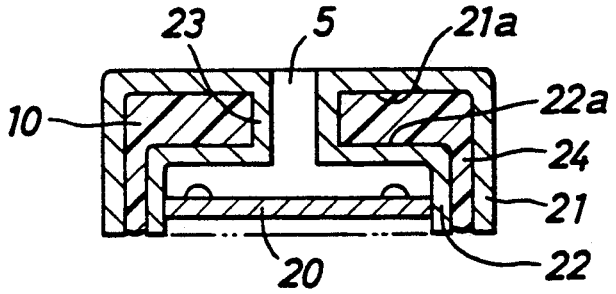
FIG. 6 is a sectional view taken along a line 6—6 in FIG. 5.
Figure 7:
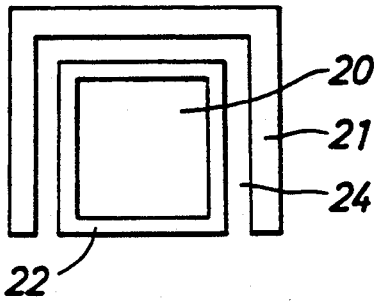
FIG. 7 is a bottom view of the focus pack shown in FIG. 5.

FIGS. 5 to 7 show the arrangement of an embodiment of a focus pack constituting a flyback transformer according to the present invention. Referring to these drawings, a focus pack 2 includes an outer case portion 21 and an inner case portion 22. A top wall inner surface 21*a* of the outer case portion 21 and a top wall outer surface 22*a* of the inner case 22 are coupled to each other through a coupling portion 23 and are integrally formed by injection molding. Gaps 24 are defined between the inner wall of the outer case portion 21 and the outer wall of the inner case portion 22 except for the coupling portion 23.

A board 20 is housed in the inner case 22. Similar to the prior art, a resistor circuit including a resistive element for setting a focus adjusting voltage and a resistive element for setting a screen adjusting voltage is formed on the board 20. In addition, a focus insertion hole 5 and a screen insertion hole 6 are formed in the coupling portion 23 to communicate with the inner space of the inner case portion 22. A focus shaft (not shown) is rotatably inserted in the focus insertion hole 5. Similarly, a screen shaft is rotatably inserted in the screen insertion hole 6. Similar to the prior art, when the focus shaft is rotated to cause a slider mounted thereon to slide on the resistive element of a focus adjusting voltage setting portion, a focus adjusting voltage corresponding to the position of the slider is set. Similarly, when the screen shaft is rotated to cause a slider mounted thereon to slide on the resistive element as a screen adjusting voltage setting portion, a screen adjusting voltage corresponding to the position of the slide is extracted.

According to this embodiment, since the outer case portion 21 and the inner case portion 22 are integrally formed, the cumbersome conventional operation of separately manufacturing the outer and inner cases 21 and 22 and assembling the cases by fitting them can be omitted, and the work efficiency of the manufacture and assembly of a focus pack is greatly improved.

In addition, since an insulating casting resin 10 such as an epoxy resin is injected into the gaps 24 between the outer case portion 21 and the inner case portion 22, the breakdown voltage of the resistor circuit formed on the board 20 is increased to eliminate the possibility of electrical discharge from the resistor circuit to the outside, thus ensuring great safety in use.

Furthermore, since the focus and screen insertion holes 5 and 6 are formed in the coupling portion 23, the insulating casting resin 10 does not leak from the insertion holes 5 and 6 when it is injected into the gaps 24 between the outer and inner case portion 21 and 22, thus providing great advantages.

The present invention is not limited to the embodiment described above but can be modified in various manners. For example, the focus pack of the above embodiment is designed to allow variable setting of both a focus adjusting voltage and a screen adjusting voltage. However, the screen insertion hole 4 and the screen shaft may be omitted to allow variable setting of only a focus adjusting voltage. In this case, a screen adjusting voltage is to be variably set on a board other than the board of the focus pack, e.g., a board of a television set.

According to the present invention, since the outer and inner case portions constituting the focus pack are integrally formed, the cumbersome conventional operation of separately manufacturing the outer and inner cases and assembling the cases by fitting them can be omitted, and the work efficiency of the manufacture and assembly of a focus pack is greatly improved. With this improvement, the cost of the apparatus can be greatly decreased.

In addition, since the outer and inner case portions are integrally formed, there is no possibility of misfitting of the outer and inner cases or floating of the outer case from the inner case, unlike the prior art. This increases the dimensional accuracy of the focus pack and prevents electrical discharge from a gap in the misfitting portion or leakage of an insulating casting resin injected between the outer and inner cases, thereby providing a flyback transformer having a focus pack with multiple protection which provides greater safety in terms of breakdown voltage.

What is claimed is:

1. A focus pack comprising:
   - an inner case including at least a variable focus adjusting voltage setting resistive element;
   - an outer case disposed about said inner case;
   - a coupling portion integrally formed with said inner case and outer case for coupling said cases to each other, the coupling portion being located at a central part of the cases and defining gaps between said inner and outer cases;
   - a focus shaft insertion hole formed in said coupling portion extending through said inner and outer cases and adapted to receive a rotatable focus shaft; and
   - an insulating resin injected into the gaps between said inner and outer cases.

2. A focus pack according to claim 1, including a screen shaft insertion hold formed in said coupling portion, extending through said inner and outer cases and adapted to receive a rotatable screen shaft.

3. A focus pack mounted on a transformer case of a flyback transformer comprising:
   - an inner case housing a ceramic board including a resistor circuit having a first resistive element for setting a focus adjusting voltage and a second resistive element for setting a screen adjusting voltage;
   - an outer case disposed about said inner case;
   - a coupling portion integrally formed with said inner case and outer case for coupling said cases to each other, the coupling portion being located at a central part of the cases and defining gaps between said inner and outer cases;

a focus shaft insertion hole formed in said coupling portion extending through said inner and outer cases and adapted to receive a rotatable focus shaft;

a screen shaft insertion hole formed in said coupling portion extending through said inner and outer cases and adapted to receive a rotatable screen shaft; and an insulating resin injected into said gaps for preventing electrical discharge from said resistor circuit to outside of said outer case.

4. A focus pack comprising:

an inner case including at least a variable focus adjusting voltage setting resistive element;

an outer case disposed about said inner case;

a coupling portion integrally formed with said inner case and outer case, forming the sole connection between said cases and defining gaps between said inner and outer cases;

a focus shaft insertion hole formed in said coupling portion extending through said inner and outer cases and adapted to receive a rotatable focus shaft; and an insulating resin injected into the gaps between said inner and outer cases.

5. A focus pack mounted on a transformer case of a flyback transformer comprising:

an inner case housing a ceramic board including a resistor circuit having a first resistive element for setting a focus adjusting voltage and a second resistive element for setting a screen adjusting voltage;

an outer case disposed about said inner case;

a coupling portion integrally formed with said inner case and outer case, forming the sole connection between said cases to each other, the coupling portion being located at a central part of the cases and defining gaps between said inner and outer cases;

a focus shaft insertion hole formed in said coupling portion extending through said inner and outer cases and adapted to receive a rotatable focus shaft;

a screen shaft insertion hole formed in said coupling portion extending through said inner and outer cases and adapted to receive a rotatable screen shaft; and an insulating resin injected into said gaps for preventing electrical discharge from said resistor circuit to outside of said outer case.

6. A focus pack comprising:

an inner case including at least a variable focus adjusting voltage setting resistive element;

an outer case disposed about said inner case;

a coupling portion connecting the cases to each other and defining gaps between the inner and outer cases;

the inner case, the outer case and the coupling portion being integrally formed by simultaneously injection molding them so that the coupling portion forms the sole connection between the cases;

a focus shaft insertion hole formed in the coupling portion extending through the inner and the outer cases and adapted to receive a rotatable focus shaft; and an insulating resin injected into the gaps between the inner and the outer cases after they have been injection molded.

* * * * *